US008669717B2

(12) United States Patent
Riesebosch

(10) Patent No.: US 8,669,717 B2
(45) Date of Patent: Mar. 11, 2014

(54) EXTERIOR ILLUMINATION AND EMERGENCY SIGNALING SYSTEM AND RELATED METHODS

(75) Inventor: Scott Riesebosch, Ontario (CA)

(73) Assignee: CRS Electronics, Ontario (CA)

( * ) Notice: Subject to any disclaimer, the term of this patent is extended or adjusted under 35 U.S.C. 154(b) by 521 days.

(21) Appl. No.: 12/945,364

(22) Filed: Nov. 12, 2010

(65) Prior Publication Data

US 2012/0119679 A1 May 17, 2012

(51) Int. Cl.
*G05F 1/00* (2006.01)

(52) U.S. Cl.
USPC ..... 315/291; 315/307; 315/185 S; 315/312; 315/158

(58) Field of Classification Search
USPC ..... 315/247, 224, 225, 185 S, 291, 315/307–312, 249–259
See application file for complete search history.

(56) References Cited

U.S. PATENT DOCUMENTS

| | | | |
|---|---|---|---|
| 5,479,159 | A | 12/1995 | Kelly |
| 6,204,615 | B1 | 3/2001 | Levy |
| 6,717,660 | B1 | 4/2004 | Bernardo |
| 7,254,372 | B2 | 8/2007 | Janusz et al. |
| 7,520,634 | B2 | 4/2009 | Ducharme et al. |
| 7,546,168 | B2 | 6/2009 | Walters et al. |
| 7,549,773 | B2 | 6/2009 | Lim |
| 7,597,455 | B2 | 10/2009 | Smith et al. |
| 2005/0151846 | A1 | 7/2005 | Thornhill |
| 2006/0092638 | A1 | 5/2006 | Harwood |
| 2006/0097136 | A1 | 5/2006 | Baxter |
| 2007/0008104 | A1 | 1/2007 | McBain |
| 2009/0002982 | A1 | 1/2009 | Hu et al. |
| 2009/0033504 | A1 | 2/2009 | Tsai et al. |
| 2009/0066258 | A1 | 3/2009 | Cleland et al. |
| 2009/0066540 | A1 | 3/2009 | Marinakis et al. |
| 2009/0097244 | A1 | 4/2009 | Lan et al. |
| 2009/0185376 | A1 | 7/2009 | Yu |
| 2009/0222223 | A1 | 9/2009 | Walters et al. |

FOREIGN PATENT DOCUMENTS

| | | | |
|---|---|---|---|
| CN | 2152364 | | 1/1994 |
| CN | 101389172 | A | 9/2007 |
| CN | 101159088 | A | 11/2007 |
| CN | 201039544 | A | 3/2008 |
| CN | 201044529 | Y | 4/2008 |
| CN | 201178509 | Y | 1/2009 |

(Continued)

OTHER PUBLICATIONS ecoGizmo, "LED streetlight smart management system undergoes testing", http://www.gizmag.com/led-streetlight-smart-management-system/11138/.

Wrangler Limited, "Street Light Management by New Digital Power Controller", http://www.wranglerltd.com/Street%20Light%20Management%20by%20New%20Digital%20Power%20 Controller.pdf.

(Continued)

*Primary Examiner* — Tuyet Thi Vo
(74) *Attorney, Agent, or Firm* — Bingham McCutchen LLP

(57) ABSTRACT

LEDs that provide street illumination are used to create emergency signals. This facilitates simple retrofitting of existing streetlighting infrastructure. In one embodiment, a streetlight comprises an LED set that itself comprises or consists of a plurality of LEDs collectively producing a white light output. The streetlight also includes a receiver for receiving a signal of an alarm condition, and a controller for (i) disabling the LED set during a daylight period, (ii) maintaining the normal operating mode during a lighting period distinct from the daylight period, and (iii) in response to the alarm condition detected by the receiver, de-activating at least one of the LEDs to produce a non-white (e.g., red or amber) output signaling the alarm condition.

17 Claims, 3 Drawing Sheets

(56) References Cited

FOREIGN PATENT DOCUMENTS

| | | | |
|---|---|---|---|
| CN | 101370334 | A | 2/2009 |
| EP | 1768086 | A1 | 3/2007 |
| EP | 2128833 | | 12/2009 |
| GB | 2392326 | A | 8/2002 |
| JP | 10206183 | | 8/1998 |
| JP | 00/251502 | | 9/2000 |
| JP | 2002083694 | A | 12/2000 |
| JP | 3491689 | | 1/2004 |
| JP | 04/185814 | | 7/2004 |
| JP | 2005100763 | A | 4/2005 |
| JP | 08/305768 | | 12/2008 |
| WO | 9802859 | A1 | 1/1998 |
| WO | 2004073359 | A1 | 8/2004 |
| WO | 2006003686 | A1 | 1/2006 |
| WO | 2008048059 | A1 | 4/2008 |
| WO | 2008117072 | A2 | 10/2008 |
| WO | 2009003512 | A1 | 1/2009 |
| WO | 2009010062 | A1 | 1/2009 |
| WO | 2009017353 | A2 | 5/2009 |
| WO | 2009103245 | A1 | 8/2009 |

OTHER PUBLICATIONS

"A remotely reconfigurable event management and status notification system", http://www.simtech.a-star.edu.sg/Research/TechnicalReports/STR_V9_N1_CD_Version/STR_V9_N1_08_MEC.pdf.

"Streetlight Monitoring & Control System", http://www.power-one.com/illumination-controls/.

"Street Light sensor technology does double duty", http://www.nivis.com/TechStreetLights/.

"Wireless Facilities Management System (WFMS)", http://www.wwsinternational.com.au/pdfs/maestro/Maestro%20Wireless%20Facilities%20Management%20System.pdf.

"Remote street lighting Monitoring and Control system", http://www.carbontrust.co.uk/NR/rdonlyres/DB865F46-C9A0-435B-AE90-FC5E45F845E6/0/2004101813.pdf.

"LED Lighting Electronics with Remote Monitoring and Control", http://www.astri.org/en/TCFS/LED-Electronics-Theme200905.pdf.

International Search Report and Written Opinion mailed Apr. 19, 2012 for International Application No. PCT/IB2011/002963 (8 pages).

EXTERIOR ILLUMINATION AND EMERGENCY SIGNALING SYSTEM AND RELATED METHODS

TECHNICAL FIELD

In various embodiments, the invention relates to exterior lighting, such as streetlighting, and emergency signaling systems.

BACKGROUND

Municipal and highway lighting systems provide roadway illumination and signaling (primarily via traffic lights). These functions are separate and provided by physically distinct fixtures. The cost to install, maintain and operate such lighting systems is considerable, and for this reason they are deployed strictly on an as-needed basis. The technology and deployment criteria have not changed significantly in many years.

Emergency communication systems, by contrast, have advanced considerably and attracted substantial investment by municipal, state and federal government. For example, the "AMBER Alert" program involves cooperation among law-enforcement agencies, broadcasters, transportation agencies, and the wireless industry to disseminate widespread alerts in child-abduction cases. AMBER Alerts interrupt regular programming and appear on radio and television and on highway signs, as well as on lottery tickets, wireless devices such as mobile phones, and over the Internet.

Unfortunately, even widely adopted and intensively deployed programs such as the AMBER alert system have limits in terms of the signaling modalities that may be mobilized. Systems to warn of other types of emergencies, such as impending tornadoes and floods, have hardly advanced at all beyond sirens and media broadcasts. Indeed, despite the increasing ability of local officials not only to detect emergency conditions but also to identify the specific regions at risk, their ability to actually issue warnings to individuals in the affected areas is limited by existing infrastructure—which, as noted above, utilizes highly task-specific fixtures. It is unrealistic to envision investment in parallel signaling systems when many communities, faced with strained municipal budgets, are actually cutting back on basic streetlight illumination.

SUMMARY OF THE INVENTION

In various embodiments, the present invention allows traditional streetlights to provide emergency signaling capability without the need for additional, dedicated lighting devices. While streetlights with emergency signaling features are known (see, e.g., U.S. Pat. No. 7,597,455), these systems require additional task-specific lighting devices that not only represent additional expense, but must be separately tested and maintained; the need to replace the primary illumination device, for example, provides no indication regarding the operability of the emergency illumination devices, which are used far less frequently.

The present invention utilizes light-emitting diodes (LEDs), which have been increasingly adopted for a wide variety of lighting tasks due to their long life, low power requirements, and low heat generation. In embodiments of the invention, the LEDs that provide street illumination are the same ones used to create emergency signals. This facilitates simple retrofitting of existing streetlighting infrastructure, which many communities are already contemplating simply to obtain the benefits of LED-based systems.

Accordingly, in a first aspect, the invention relates to a streetlight comprising an LED set that itself comprises an LED set comprising or consisting of a plurality of LEDs all of which are active in a normal operating mode to collectively produce a white light output. As used herein, the term "white" light refers broadly to the range of light outputs commonly recognized in the lighting art as white. This range includes, without limitation, "warm" white light (which is reddish) and "cold" white light (which is bluish). In some embodiments, the LED set comprises first and second LEDs active in a normal operating mode to collectively produce a warm white light output (the first LED individually having a red output). A warm white light output is standard in many outdoor illumination systems. In other embodiments, the LED set comprises red, green and blue LEDs which, in the normal operating mode, collectively produce a white light output.

The streetlight also includes a receiver for receiving a signal of an alarm condition, and a controller for (i) disabling the LED set during a daylight period, (ii) maintaining the normal operating mode during a lighting period distinct from the daylight period, and (iii) in response to the emergency condition detected by the receiver, de-activating at least one (but not all) of the LEDs to produce a non-white output signaling the alarm condition. In typical implementations, the red LED will be active and all of the other LED or LEDs will be rendered inactive to produce a pure red or amber signal. The emergency signal, in other words, requires no activation of additional LEDs that do not contribute to the normal-operating-mode illumination.

The terms "LED" and "LED set" are used broadly herein to connote numerous possible configurations. For example, a streetlight may contain not one but several or even many LED sets (each set of LEDs together creating white light). The LEDs may be separate packaged devices, each including an LED chip or "die" surrounded by a resin dome, or may instead be packaged together in a single dual device. So long as the LEDs are separately drivable in accordance herewith and arranged so their light outputs mix appropriately, the precise configuration is not critical.

Accordingly, in a first aspect, the invention relates to a streetlight comprising an LED set that itself includes a plurality of LEDs all of which are active in a normal operating mode to collectively produce a white light output; a receiver for receiving a signal of an alarm condition; and a controller. In various embodiments, the controller disables the LED set during a daylight period, maintains the normal operating mode during a lighting period distinct from the daylight period, and in response to the alarm condition detected by the receiver, de-activates at least one of the LEDs to produce a non-white output signaling the alarm condition.

In some embodiments, the LED set comprises or consists of first and second LEDs which, in the normal operating mode, collectively produce a warm white light output. The first LED may individually have a red or amber output (e.g., a peak output wavelength in the range 580 to 750 nm, such as a red output in the 620 to 630 nm wavelength range), and second LED may have a peak output wavelength of 510 nm. In response to the alarm condition, the controller may activate the first LED and de-activate the second LED during the daylight period and the lighting period. In other embodiments, the LED set comprises red, green and blue LEDs which, in the normal operating mode, collectively produce the white light output; and in response to the alarm condition detected by the receiver, the controller activates the red LED and de-activates the green and blue LEDs.

The receiver may be configured to receive wireless signals or wired signals, or both. In one particular embodiment, the second LED comprises a die having an intrinsic peak output wavelength in the range 430 to 480 nm and a lumiphore for receiving a portion of the die light output and emitting output light of a different peak wavelength; the 510 nm light includes a mixture of output light from the die and output light from the lumiphore.

A warm light output may be defined in various ways. For example, it may have a correleted color temperature in the range 2,600 Kelvin to 5,000 Kelvin. Alternatively, it may be defined as having coordinates on a 1931 CIE Chromaticity Diagram that are within 10 MacAdam ellipses of at least one point on the black-body locus on the 1931 CIE Chromaticity Diagram.

In another aspect, the invention relates a method of lighting. In various embodiments, the method comprises the steps of providing, in a normal operating mode, light from a plurality of proximate LEDs, where the light from the LEDs combines to produce a white light output; receiving a signal of an alarm condition; and in response to the alarm condition, de-activating at least one of the LEDs to produce a non-white output signaling the alarm condition.

In some embodiments, the plurality of LEDs comprises or consists of first and second LEDs that collectively produce a warm white light output, the first LED individually having a red or amber output; and in response to the alarm condition, the second LED is de-activated. In other embodiments, the plurality of LEDs comprises or consists of red, green and blue LEDs that collectively produce the white light output; and in response to the alarm condition, the green and blue LEDs are de-activated. The signal may be transmitted wirelessly or via a wire.

In still another aspect, the invention relates to a method of signaling an alarm condition using a network of streetlights each providing, in a normal operating mode, light from a plurality of proximate LEDs. The light from the LEDs combines to produce a white light output. In various embodiments, the method comprises the steps of identifying a subset of the streetlights in the network having geographic locations within a defined emergency zone; and in the streetlights within the identified subset, de-activating at least one of the LEDs to produce a non-white output signaling the alarm condition. The de-activating step may, for example, comprise sending an emergency-condition signal only to the streetlights within the identified subset. In some embodiments, each of the streetlights is associated with an identifier; and in such embodiments, the de-activating step may comprise sending an emergency-condition signal to all of the streetlights in the network, where the signal includes identifiers of the streetlights within the identified subset. Only the streetlights whose identifiers are included in the signal respond by de-activating at least one of the LEDs.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

In the following description, various embodiments of the present invention are described with reference to the following drawings, in which.

DESCRIPTION

Figure 1:
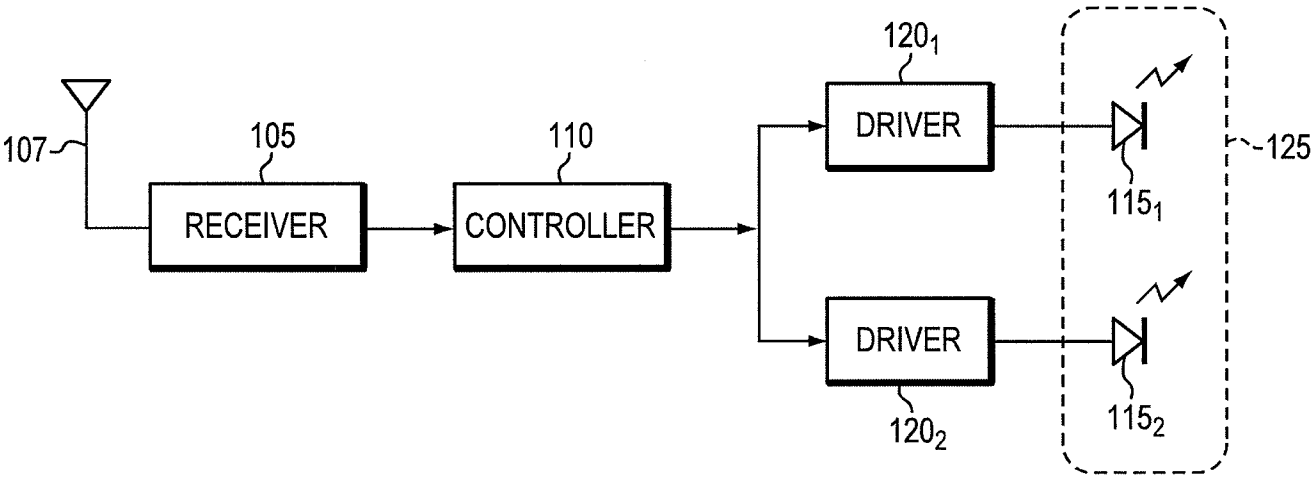
FIG. 1 schematically illustrates a system in accordance with the invention.

With reference to FIG. 1, a system 100 according to the invention includes a receiver 105, which may be wired or wireless; in wireless configurations, receiver 105 is connected to an antenna 107. Receiver 105 detects signals indicating an alarm or emergency condition, transmitted, for example, from a command center operated by local municipal authorities.

The receiver 105 is in communication with a controller 110, which itself governs the operation of a set of LEDs that collectively produce white light. The LED set may comprise or consist of, for example, red, green and blue LEDs; or red and green LEDs that collectively produce warm white light; or any other set of LEDs that collectively produce white light, although it is preferred that at least one of the LEDs in the set has a red output to signal the emergency condition.

A set of two LEDs $\mathbf{115}_1$, $\mathbf{115}_2$ (collectively, 115) is illustrated in FIG. 1, and is driven by means of respective associated drivers $\mathbf{120}_1$, $\mathbf{120}_2$ (collectively, 120). In the illustrated embodiment, one of the LEDs 115 has a red or amber output, while the other LED 115 emits at a smaller peak wavelength so that, when the light from LEDs 115 mixes, the output is a warm white light (as further discussed below). The ensuing discussion focuses on a red output, but it should be understood that amber light—e.g., to signal an AMBER Alert—is contemplated as well.

The drivers 120 are conventional circuits that provide power to the LEDs 115. Controller 110 ordinarily causes both drivers 120 to turn on or turn off both of the LEDs 115 in accordance with a schedule (using an internal clock, which may be remotely programmable via receiver 105), in response to sensed levels of ambient light, or based on some other condition. Controller 110 may also dictate the power levels applied by drivers 120 depending on, for example, measurements of LED output to compensate for changes due to aging. Upon receipt of the alarm signal from receiver 105, controller 110 terminates operation of one of the drivers 120 so that only the red LED is illuminated, thereby producing a red emergency signal.

The alarm signal may operate only certain streetlights equipped with a system 100. For example, streetlights may be organized into a network, with each streetlight assigned a unique identifier. At the command center, officials may designate a specific region within which the streetlights are to shift to a red-only output. This may be implemented, for example, using a simple mapping system in which each streetlight is associated with geographic coordinates as well as its unique identifier. When the responsible official identifies the emergency zone, the mapping system determines which streetlights have geographic coordinates within the zone. The zone may be identified in any suitable fashion. For example, a stylus may be used to draw a closed boundary on a computer display tablet showing a map of the area. Alternatively, specific streets, neighborhoods or entire cities may be entered by, e.g., menu selection. So long as a database relates streetlight identifiers to geographic coordinates and a regional selection can be expressed in or related to such coordinates, any approach to selection is suitable.

In some embodiments, alarm signals are transmitted only to the identified streetlights. In other embodiments, alarm signals are broadcast over the entire network but include the identifiers of the streetlights that will indicate the emergency condition. In the manner of LAN-connected computers responding to MAC addresses, only those streetlights detecting (via associated controllers 110) their addresses in the multicast alarm signal indicate the emergency condition.

The controller 110 is conventional and straightforwardly implemented. Systems for controlling LED-based lighting are well-known in the art, as are network-addressable control systems that respond to, for example, address-based communication streams. Controller 110 may be implemented in hardware, software or a combination of the two. For embodiments in which the functions are provided as one or more software programs, the programs may be written in any of a number of high level languages such as FORTRAN, PASCAL, JAVA, C, C++, C#, BASIC, various scripting languages, and/or HTML. Additionally, the software can be implemented in an assembly language directed to the microprocessor resident on a target computer; for example, the software may be implemented in Intel 80×86 assembly language if it is configured to run on an IBM PC or PC clone. The software may be embodied on an article of manufacture including, but not limited to, a floppy disk, a jump drive, a hard disk, an optical disk, a magnetic tape, a PROM, an EPROM, EEPROM, field-programmable gate array, or CD-ROM. Embodiments using hardware circuitry may be implemented using, for example, one or more FPGA, CPLD or ASIC processors.

LEDs 115 are located sufficiently proximate to each other (as indicated by the envelope 125) for their light outputs to mix to create a warm white light. To appreciate what is meant by this term, it is useful to refer to "color temperature" and to chromaticity diagrams. The color temperature of a light source is the temperature of an ideal black-body radiator that radiates light having a comparable hue. The temperature is conventionally stated in units of absolute temperature, Kelvin (K). A chromaticity diagram allows all colors to be defined, and represented in the diagram, as weighted sums of primary colors. The 1931 CIE Chromaticity Diagram (an international standard for primary colors established in 1931), and the 1976 CIE Chromaticity Diagram (similar to the 1931 diagram but modified such that similar distances on the diagram represent similar perceived differences in color) provide useful reference for defining colors in terms of primary colors. In the 1931 Diagram, deviation from a point thereon can be expressed either in terms of the coordinates or, alternatively—in order to indicate the extent of the perceived difference in color—in terms of "MacAdam ellipses." For example, a locus of points defined as being ten MacAdam ellipses from a specified hue defined by a particular set of coordinates on the 1931 Diagram consists of hues that would be perceived as differing from the specified hue to a common extent.

In the present context, a warm white light output may have a correleted color temperature in the range 2,600 Kelvin to 5,000 Kelvin. Alternatively, warm white light may be defined relative to a chromaticity diagram. For example, the warm output light may have coordinates on the 1931 CIE Chromaticity Diagram that are within 10 MacAdam ellipses of at least one point on the black-body locus on the 1931 CIE Chromaticity Diagram.

Because light that is perceived as white is necessarily a blend of light of two or more colors (or wavelengths), no single LED can produce white light. Instead, "white" LEDs typically refer to LED sets having red, green and blue LEDs, or to an LED that emits blue light in combination with a luminescent material (e.g., a phosphor or, more generally, a lumiphore) that emits yellow light in response to excitation by the blue LED output. The blue light and the yellow light, when mixed, produce light that is perceived as white light. Warm white light as understood herein may be produced by two LEDs, the first of which—i.e., the red or amber LED—has a peak output wavelength in the range 580 to 750 nm, e.g., in the range 620 to 630 nm for red light; and the second of which has a peak output wavelength of 510 nm. In some embodiments, the second LED comprises a die having an intrinsic peak output wavelength in the range 430 to 480 nm and a lumiphore for receiving a portion of the die light output and emitting output light of a different peak wavelength; the 510 nm light includes a mixture of output light from the die and output light from the lumiphore.

Figure 2:
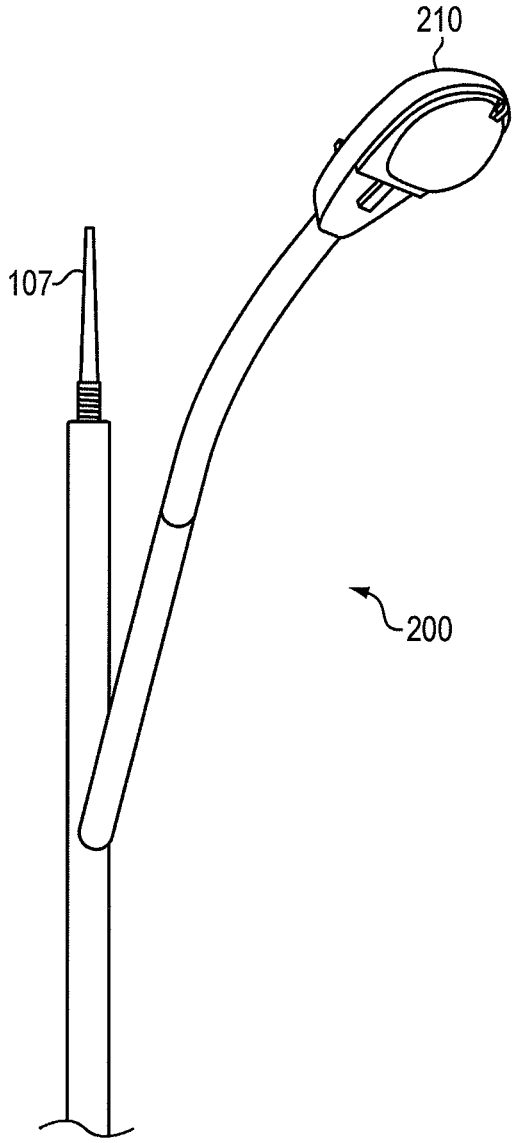
FIG. 2 is a perspective view of a streetlamp equipped for wireless communication in accordance with various embodiments hereof.
Figure 3:
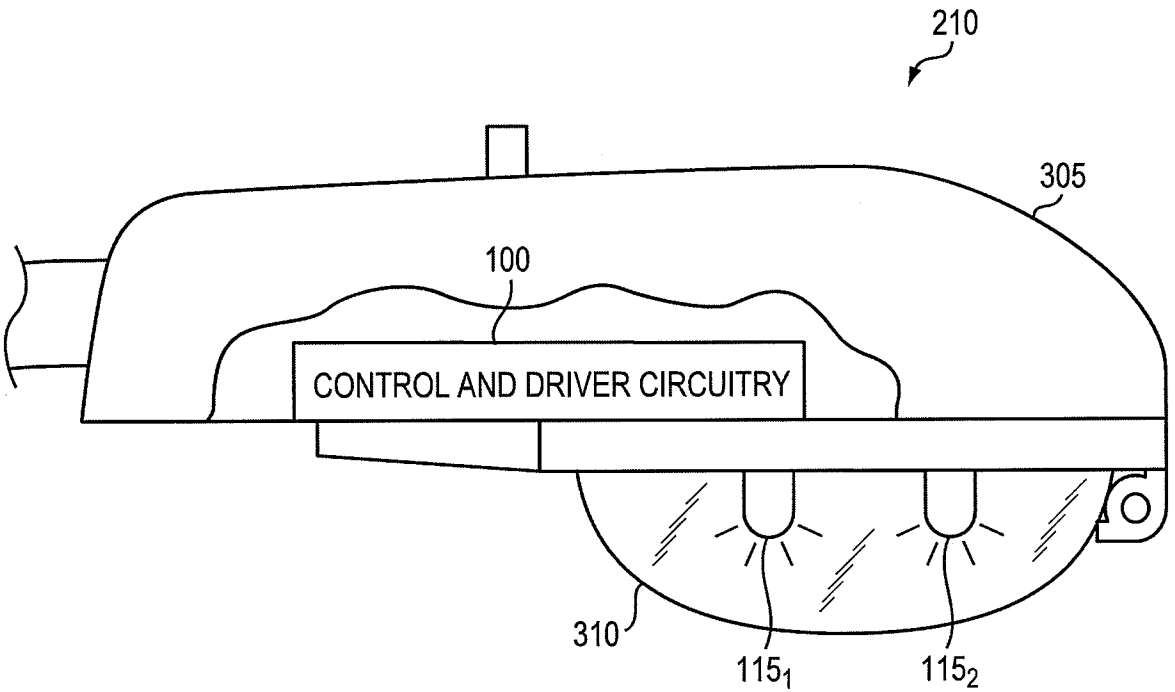
FIG. 3 is a partial cutaway elevation of a streetlamp head implementing the invention.

A representative streetlight deployment 200 is illustrated FIGS. 2 and 3. The streetlight 200 includes an antenna 107 for receiving wireless signals that dictate the operation of LEDs 115. The streetlight 200 includes a conventional lamp-head assembly 210, which itself has a housing 305 and a transparent dome 310. The dome 310 surrounds the LEDs 115. Within housing 305 is circuitry implementing the system 100 discussed above.

Although only two LEDs 115 are shown in the figures, this is for illustrative purposes only. Depending on the light output required, streetlight 200 may contain not one but several or even many LED pairs 115. For example, pairs of LEDs 115 may be arranged in rows, in concentric circles, etc. so long as their light outputs mix appropriately when both LEDs of a pair are active. Each LED 115 may be a separate packaged device, as shown, and including an LED chip surrounded by a resin dome. Alternatively, pairs of LED chips may be packaged together in a single dual device, i.e., in a single package. So long as the LEDs are separately drivable, so that the light output may be altered on command from warm white illumination to the red emergency signal, the precise configuration is not critical.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A streetlight comprising: an LED set comprising a plurality of LEDs all of which are active in a normal operating mode to collectively produce a white light output; a receiver for receiving a signal of an alarm condition; and a controller for (i) disabling the LED set during a daylight period, (ii) maintaining the normal operating mode during a lighting period distinct from the daylight period, and (iii) in response to the alarm condition detected by the receiver, de-activating at least one of the LEDs to produce a non-white output signaling the alarm condition.

2. The streetlight of claim 1 wherein: the LED set comprises red, green and blue LEDs which, in the normal operating mode, collectively produce the white light output; and in response to the alarm condition detected by the receiver, the controller activates the red LED and de-activates the green and blue LEDs.

3. The streetlight of claim 1 wherein the receiver is configured to receive wireless signals.

4. The streetlight of claim 1 wherein the receiver is configured to receive wired signals.

5. The streetlight of claim 1 wherein: the LED set comprises first and second LEDs which, in the normal operating mode, collectively produce a warm white light output; the first LED individually has a red or amber output; and in response to the alarm condition detected by the receiver, the controller activates the first LED and de-activates the second LED.

6. The streetlight of claim 5 wherein, in response to the alarm condition, the controller activates the first LED and de-activates the second LED during the daylight period and the lighting period.

7. The streetlight of claim 5 wherein the warm light output has a correleted color temperature in the range 2,600 Kelvin to 5,000 Kelvin.

8. The streetlight of claim 7 wherein the warm output light has coordinates on a 1931 CIE Chromaticity Diagram that are within 10 MacAdam ellipses of at least one point on the black-body locus on the 1931 CIE Chromaticity Diagram.

9. The streetlight of claim 5 wherein the first LED has a peak output wavelength in the range 580 to 750 nm.

10. The streetlight of claim 9 wherein the first LED has a peak output wavelength in the range 620 to 630 nm.

11. The streetlight of claim 9 wherein the second LED has a peak output wavelength of 510 nm.

12. The streetlight of claim 11 wherein the second LED comprises a die having an intrinsic peak output wavelength in the range 430 to 480 nm and a lumiphore for receiving a portion of the die light output and emitting output light of a different peak wavelength, the 510 nm light including a mixture of output light from the die and output light from the lumiphore.

13. A method of lighting comprising the steps of: providing, in a normal operating mode, light from a plurality of proximate LEDs, the light from the LEDs combining to produce a white light output; receiving a signal of an alarm condition; and in response to the alarm condition, de-activating at least one of the LEDs to produce a non-white output signaling the alarm condition.

14. The method of claim 13 wherein: the plurality of LEDs comprises first and second LEDs that collectively produce a warm white light output, the first LED individually having a red or amber output; and in response to the alarm condition, the second LED is de-activated.

15. The method of claim 13 wherein: the plurality of LEDs comprises red, green and blue LEDs that collectively produce the white light output; and in response to the alarm condition, the green and blue LEDs are de-activated.

16. The method of claim 13 wherein the signal is transmitted wirelessly.

17. The method of claim 13 wherein the signal is transmitted via a wire.

* * * * *